US010475599B2

(12) United States Patent
Maloney et al.

(10) Patent No.: US 10,475,599 B2
(45) Date of Patent: Nov. 12, 2019

(54) CIRCUIT BREAKERS WITH HANDLE BEARING PINS

(71) Applicant: Eaton Intelligent Power Limited, Dublin (IE)

(72) Inventors: James Gerard Maloney, Industry, PA (US); Daniel Quentin Gates, Rockaway, NJ (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/843,130

(22) Filed: Dec. 15, 2017

(65) Prior Publication Data

US 2018/0108505 A1 Apr. 19, 2018

Related U.S. Application Data

(60) Continuation of application No. 15/446,668, filed on Mar. 1, 2017, now Pat. No. 9,875,872, which is a division of application No. 14/459,013, filed on Aug. 13, 2014, now Pat. No. 9,620,303.

(51) Int. Cl.

| | |
|---|---|
| ***H01H 75/00*** | (2006.01) |
| ***H01H 9/20*** | (2006.01) |
| ***H01H 3/04*** | (2006.01) |
| ***H01H 71/50*** | (2006.01) |
| ***H01H 71/52*** | (2006.01) |
| ***H01H 21/04*** | (2006.01) |

(52) U.S. Cl.

CPC ..... *H01H 9/20* (2013.01); *H01H 3/04* (2013.01); *H01H 21/04* (2013.01); *H01H 71/505* (2013.01); *H01H 71/521* (2013.01); *H01H 71/528* (2013.01)

(58) Field of Classification Search

USPC ..... 335/6, 21, 167

See application file for complete search history.

(56) References Cited

U.S. PATENT DOCUMENTS

| | | | | |
|---|---|---|---|---|
| 2,322,646 | A * | 6/1943 | Johnson | H01H 71/1009 337/42 |
| 2,618,716 | A * | 11/1952 | Boller | H01H 71/0214 200/464 |
| 2,701,284 | A * | 2/1955 | Edmunds | H01H 71/505 335/167 |
| 3,081,386 | A * | 3/1963 | Pastene | H01H 71/1027 335/159 |
| 3,110,786 | A | 11/1963 | Gelzheiser | |
| 3,171,921 | A * | 3/1965 | Woods | H01H 71/522 335/43 |
| 3,240,902 | A | 3/1966 | Gelzheiser | |
| 3,286,071 | A | 11/1966 | Gelzheiser | |
| 3,950,714 | A * | 4/1976 | Mrenna | H01H 71/40 335/35 |
| 4,276,457 | A | 6/1981 | Myers | |
| 4,904,969 | A * | 2/1990 | Bagalini | H01H 71/524 335/167 |
| 5,131,504 | A | 7/1992 | Yoo et al. | |

(Continued)

*Primary Examiner* — Alexander Talpalatski

(74) *Attorney, Agent, or Firm* — Myers Bigel, P.A.

(57) ABSTRACT

Circuit breakers with handles having at least one handle bearing pin that contacts an upper end portion of a moving arm and allows the arm to rotate to "OFF", "ON" and "TRIP" positions, typically about 90 degrees of rotation.

18 Claims, 13 Drawing Sheets

(56) References Cited

U.S. PATENT DOCUMENTS

| | | | | | |
|---|---|---|---|---|---|
| 5,164,693 | A * | 11/1992 | Yokoyama | H01H 9/46 | 335/14 |
| 5,196,815 | A * | 3/1993 | Chien | H01H 1/54 | 335/147 |
| 5,200,724 | A * | 4/1993 | Gula | H01H 71/501 | 200/401 |
| 5,675,303 | A * | 10/1997 | Kelaita, Jr. | H01H 71/462 | 335/172 |
| 5,844,188 | A * | 12/1998 | Cella | H01H 71/525 | 218/22 |
| 5,929,405 | A * | 7/1999 | Wehrli, III | H01H 3/30 | 200/400 |
| 6,087,914 | A * | 7/2000 | Kralik | H01H 71/7418 | 335/172 |
| 6,229,414 | B1 * | 5/2001 | Toyama | H01H 71/46 | 335/167 |
| 6,714,108 | B1 * | 3/2004 | Simms | H01H 3/001 | 200/240 |
| 6,759,931 | B1 * | 7/2004 | Lias | H01H 71/505 | 335/167 |
| 6,864,447 | B1 * | 3/2005 | Lipsey, II | H01H 73/14 | 200/310 |
| 6,894,594 | B2 * | 5/2005 | Fello | H01H 71/524 | 335/172 |
| 8,222,983 | B2 | 7/2012 | Zhou et al. | | |
| 8,542,083 | B2 * | 9/2013 | Maloney | H01H 71/522 | 335/167 |
| 2004/0150497 | A1 * | 8/2004 | Lias | H01H 71/10 | 335/21 |
| 2013/0076461 | A1 * | 3/2013 | Maloney | H01H 71/522 | 335/21 |
| 2013/0146428 | A1 | 6/2013 | Maloney | | |
| 2016/0049274 | A1 | 2/2016 | Maloney et al. | | |

* cited by examiner

CIRCUIT BREAKERS WITH HANDLE BEARING PINS

RELATED APPLICATIONS

This application is a continuation of U.S. application Ser. No. 15/446,668, filed Mar. 1, 2017, which claims the benefit of and priority to U.S. application Ser. No. 14/459,013, filed Aug. 13, 2014, now U.S. Pat. No. 9,620,303, issued Apr. 11, 2017, the contents of which are hereby incorporated by reference as if recited in full herein.

FIELD OF THE INVENTION

The present invention relates to circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a typical circuit breaker, current enters the system from a power line and passes through a line conductor to a stationary contact fixed on the line conductor, then to a movable contact. The movable contact is fixedly attached to a pivoting arm. As long as the stationary and movable contacts are in physical contact, current passes from the stationary contact to the movable contact and out of the circuit breaker to down-stream electrical devices.

In the event of an overcurrent condition (e.g., a short circuit), extremely high electromagnetic forces can be generated. The electromagnetic forces repel the movable contact away from the stationary contact. Because the movable contact is fixedly attached to the rotating arm, the arm pivots and physically separates the stationary and movable contacts, thus tripping the circuit. Upon separation of the contacts and blowing open the circuit, an arcing condition occurs. The breaker's trip unit will trip the breaker which will cause the contacts to separate.

In the past, as shown in FIG. 1, circuit breakers have used handle bearings that cooperate with the moving arm 25. The handle 15 pivots and the arm 25 rotates between "OFF", "ON" and "TRIP" positions. During endurance testing per UL 489, the arm 25 is rapidly repetitively moved through its operative positions. The moving arm 25 may wear into the handle or the handle may undesirably degrade, e.g., exhibit blistering due to one or more of heat, friction and/or forces from the arm.

SUMMARY OF EMBODIMENTS OF THE INVENTION

Embodiments of the present invention are directed to circuit breakers with new and inventive handle bearing configurations.

Embodiments of the invention are directed to circuit breakers. The circuit breakers include a housing, a pivotable handle held by the housing, and an arm held in the housing in communication with the handle. The circuit breaker includes at least one pin held by the handle such that a longitudinal axis of the at least one pin is parallel to and offset from a pivot axis of the pivotable handle and a moveable contact arm comprising a first end portion engaging the at least one pin and configured to move responsive to a force applied to the first end portion of the arm by the pivotable handle through the at least one pin.

The first end portion can be held in an arm receiving channel in the handle and an opposing second end portion can have an electrical movable contact. The circuit breaker can also has a stationary electrical contact held in the housing and at least one pin held by the pivotable handle and residing in the housing so that the first end portion of the arm moves against the at least one pin as the arm and handle move between ON and OFF positions in the housing.

The circuit breaker can also have a TRIP operative position. The first end portion of the arm can move against the at least one pin as the arm and handle move between the ON and OFF positions and the TRIP position.

The at least one pin can provide the only contact between the arm and the handle.

The at least one pin can be a single pin, and the first end portion of the arm can move back and forth under the pin while in continuous abutting contact with the pin.

The at least one pin can be a single pin. The pivotable handle can have a pivot attachment with an axially extending centerline (pivot axis). The pin can have an axially extending centerline. The pin centerline can be offset from the pivot axis (attachment centerline of the handle).

The pin centerline can be below and laterally offset from the pivot axis of the handle.

The first end portion of the arm can have a curvilinear pin channel that slidably holds the at least one pin.

The at least one pin can be a single pin. The first end portion of the arm can have an arcuate pin channel that holds the pin.

The pin can be non-rotatably mounted to the handle.

The at least one pin can be metallic.

The upper end portion of the arm has a width and wherein the arm receiving channel of the handle can have a width that is about the same as the arm width (e.g., a bit oversize such as 0.01 inches to about 0.1 inches to receive the arm but not allow substantial side to side movement to provide alignment with other cooperating components).

The pin can have a length that is between about 0.115 inches and about 0.328 inches, in some embodiments.

The at least one pin can be a single pin that is held in a pin aperture in the handle to span across the arm receiving channel.

The pin aperture can have a first shoulder on one side of the arm receiving channel and a blind channel residing across from the shoulder on an opposing side of the arm receiving channel. The pin extends through the shoulder, across the arm receiving channel and into the blind channel.

The circuit breaker can be configured so the arm has an elongate concave shape with the upper end portion having a tip end. The arm receiving channel can extend across an entire bottom portion of the handle and can have a tip end that allows the tip end of the arm to retract and extend therefrom. The pin can be held closer to the tip end of the arm receiving channel.

Other embodiments are directed to handle bearing assemblies for a circuit breaker.

The assemblies can include a pivotable handle for a circuit breaker configured to rotate between ON and OFF positions, the handle having an inner portion comprising an arm receiving channel and at least one pin extending across the arm receiving channel, the at least one pin configured to cooperate with an arm providing a movable contact for the circuit breaker.

The arm receiving channel can extend across an entire bottom portion of the handle and have a tip end that allows a tip end of an arm to slidably retract and extend therefrom. The at least one pin can be held closer to the tip end of the arm receiving channel. The at least one pin can provide the only contact between the arm and the handle.

The at least one pin can be a single pin. The pivotable handle can have a pivot attachment joint with an axially extending centerline (pivot axis). The pin can have an axially extending centerline and the pin centerline can be offset from the pivot axis of the handle.

The pin centerline can be laterally and longitudinally offset from the pivot axis of the handle.

The at least one pin can be a single pin. The first end portion of the arm can have an arcuate pin channel that holds the pin and the pin can be non-rotatably mounted to the handle.

The at least one pin can be a single pin that is held in a pin aperture in the handle to span across the arm receiving channel. The pin aperture can extend through a first shoulder on one side of the arm receiving channel and a blind channel residing across from the shoulder on an opposing side of the arm receiving channel. The pin can extend through the shoulder, across the arm receiving channel and into the blind channel.

The handle bearing configurations can be configured to withstand the UL 489 (standard BR2125) endurance test requirements, e.g., 10,000 repetitions of handle movement through the operative positions, without failure and/or undue degradation.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
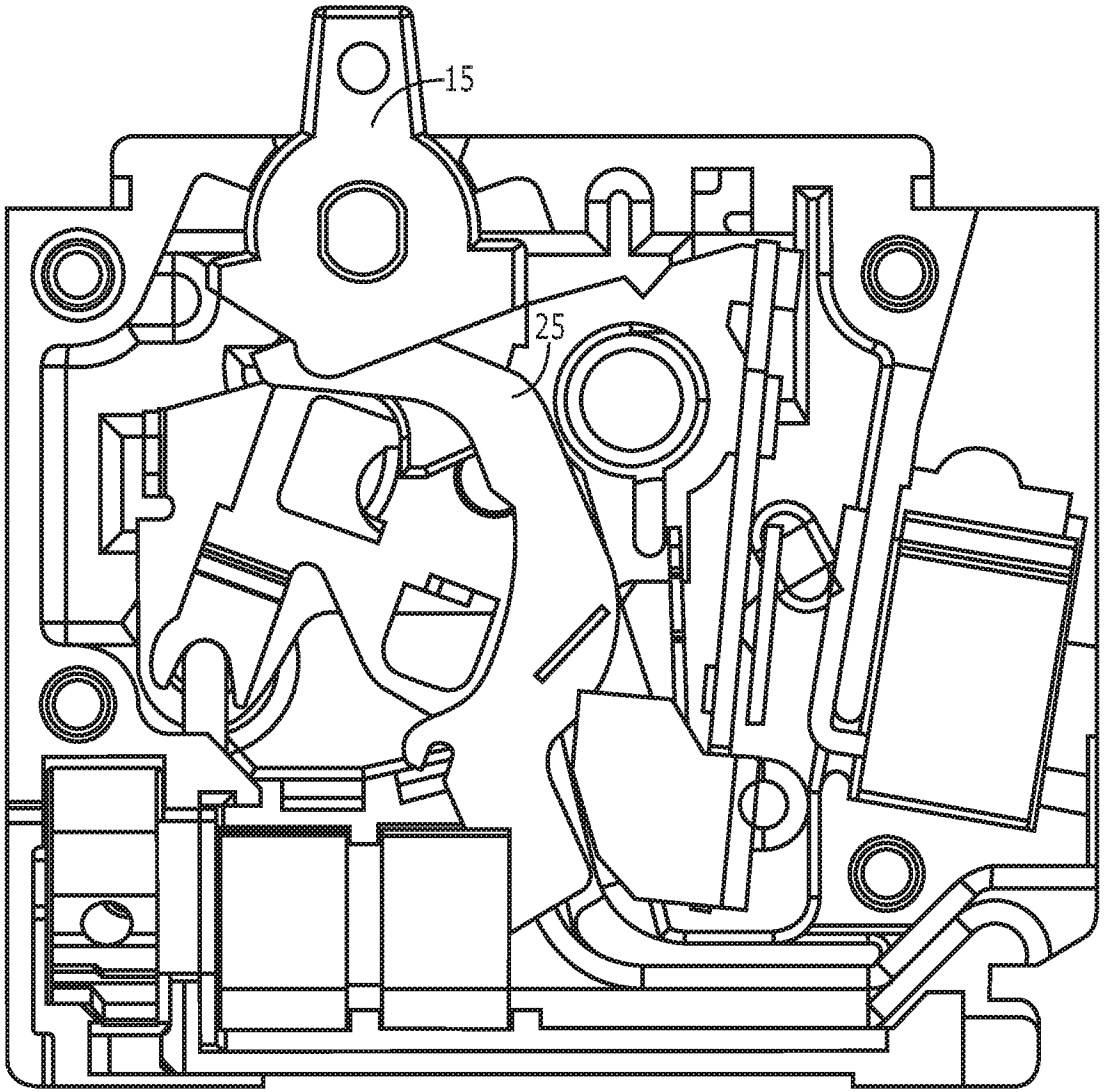
Figure 1 (PRIOR ART)
FIG. 1 is a side partial cutaway view of an exemplary prior art circuit breaker.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 40, 40', 40", 40''').

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "bottom", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass orientations of above, below and behind. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "non-ferromagnetic" means that the noted component is substantially free of ferromagnetic materials so as to be suitable for use in the arc chamber (non-disruptive to the magnetic circuit) as will be known to those of skill in the art.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

The term "self-retaining" with respect to a handle bearing pin means that the pin engages a handle to lock into an axial and non-rotatable position and requires no other retention component.

The handle can be associated with a disconnect operator (e.g., an operating handle) connected to an assembly for opening and closing separable main contacts in a circuit breaker or for turning power ON and OFF using a switch associated with a fuse. The circuit breaker can be for a motor starter unit or feeder unit, for example.

Figure 2A:
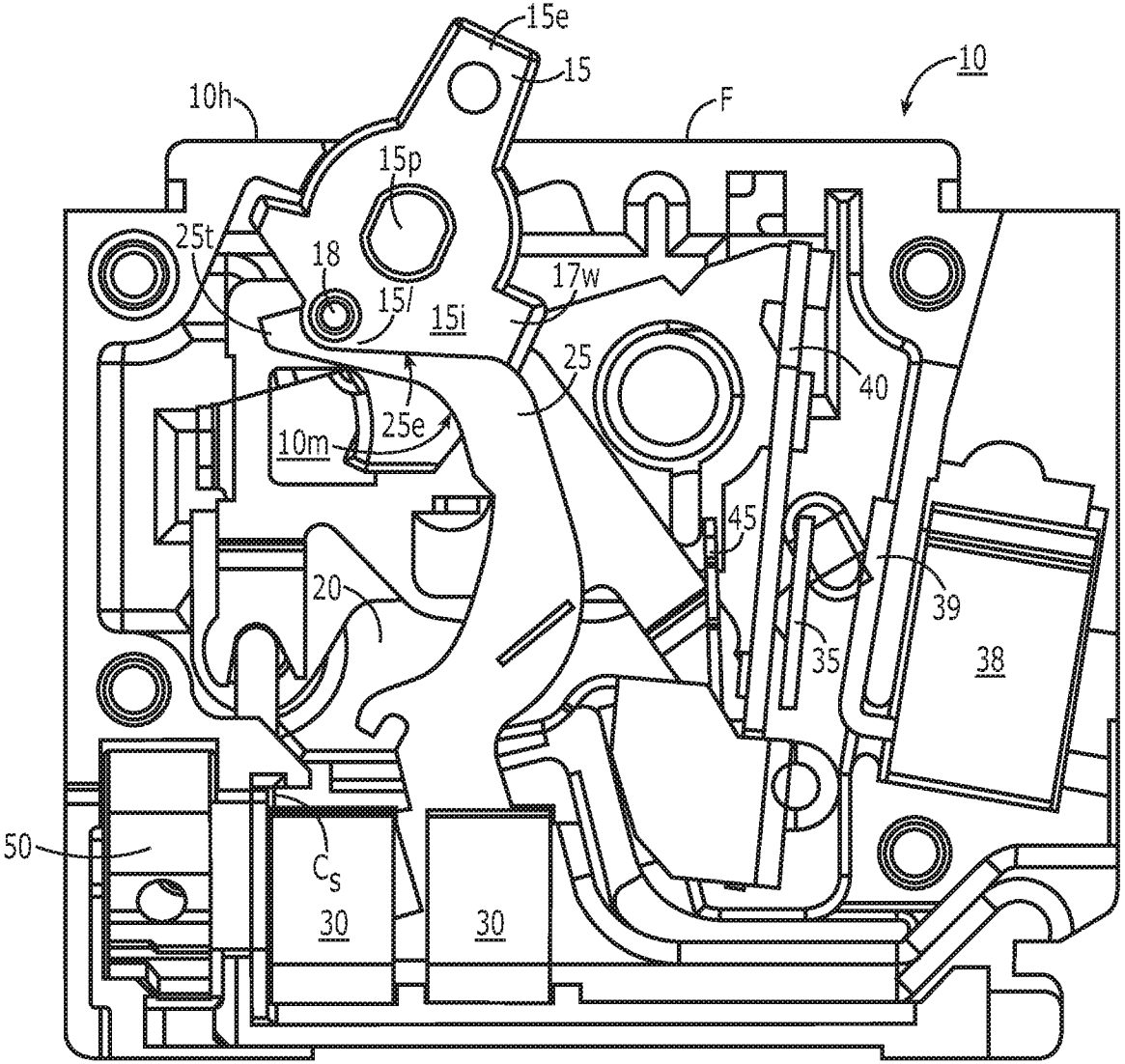
FIG. 2A is a front partial cutaway view of an exemplary circuit breaker with the handle in an exemplary "OFF" position according to embodiments of the present invention.
Figure 2B:
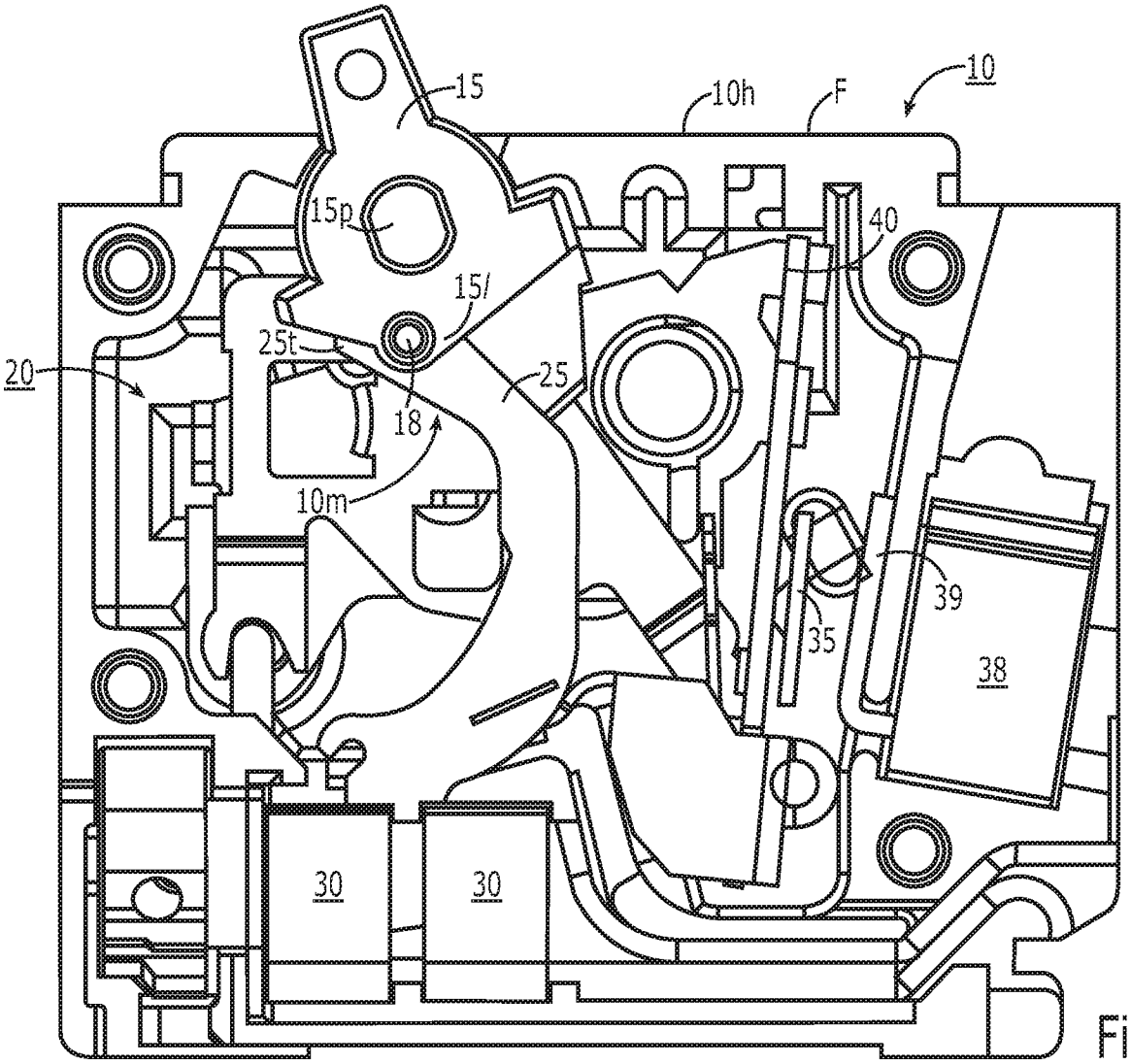
FIG. 2B is a front partial cutaway view of the circuit breaker shown in FIG. 2A illustrating the handle in an "ON" position according to embodiments of the present invention.
Figure 2C:
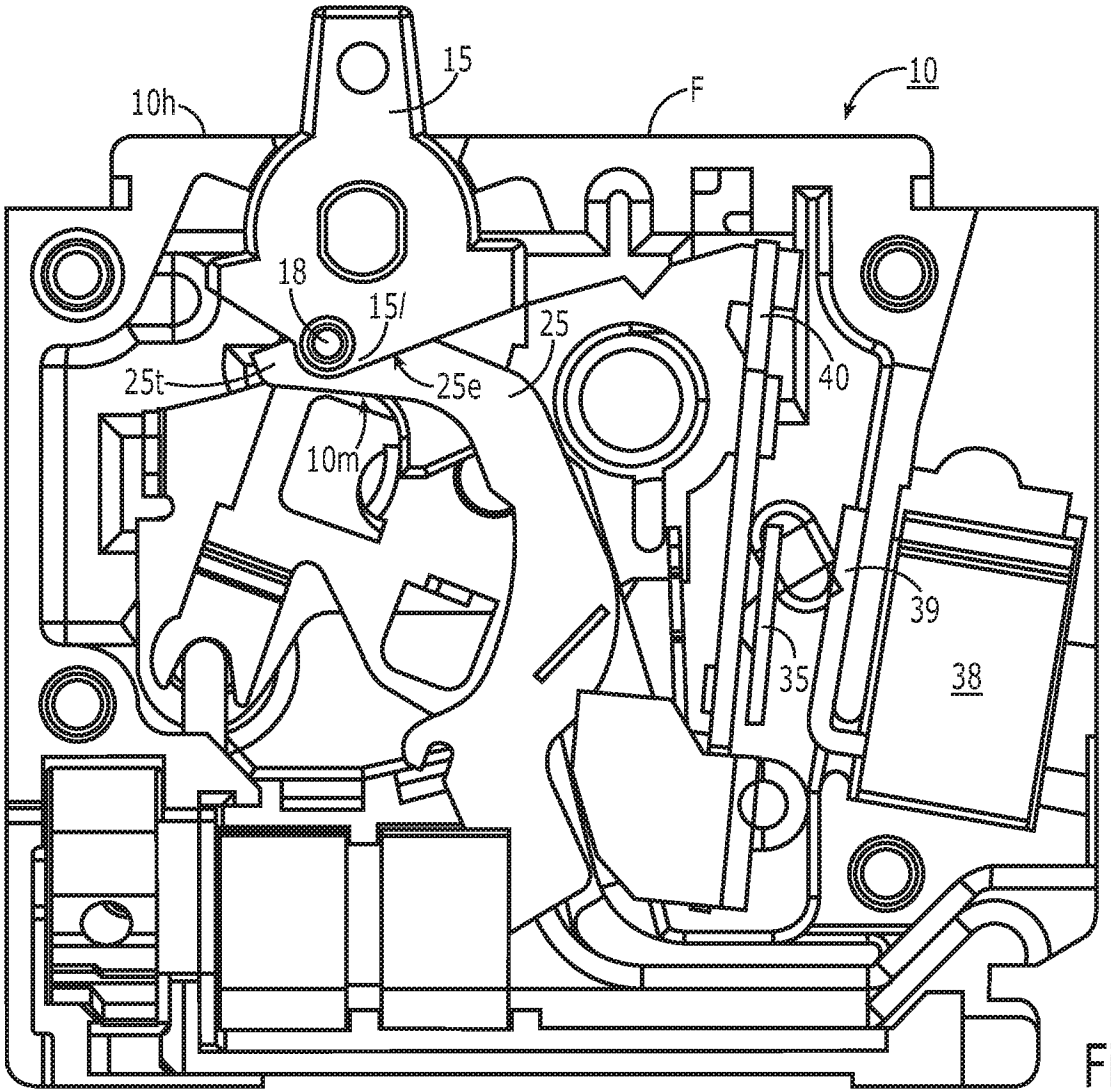
FIG. 2C is a front partial cutaway view of the circuit breaker shown in FIG. 2A illustrating the handle in a "TRIP" position according to embodiments of the present invention.
Figure 3A:
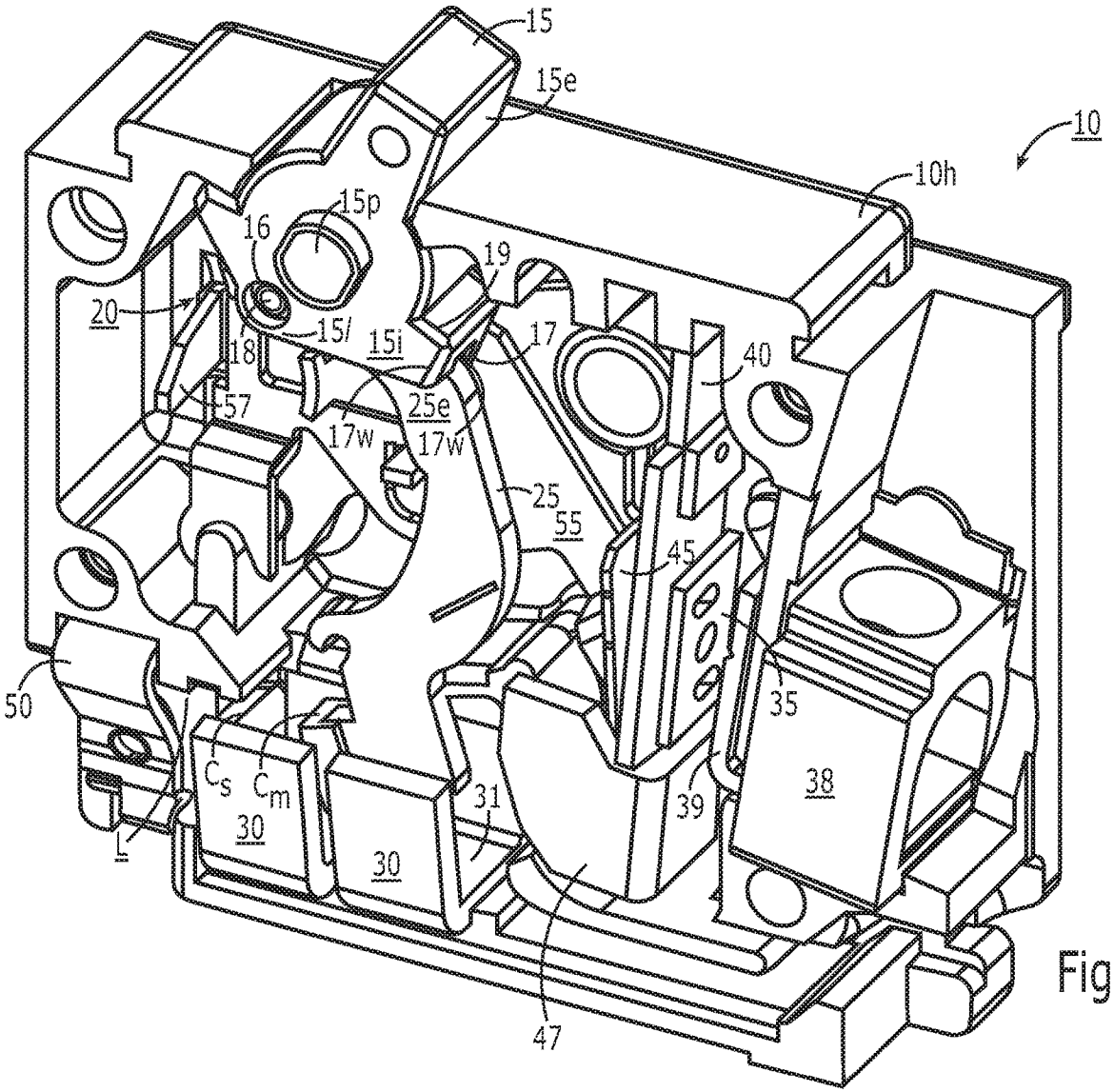
FIG. 3A is a front perspective view of an exemplary circuit breaker with the handle in an exemplary "OFF" position according to embodiments of the present invention.
Figure 3B:
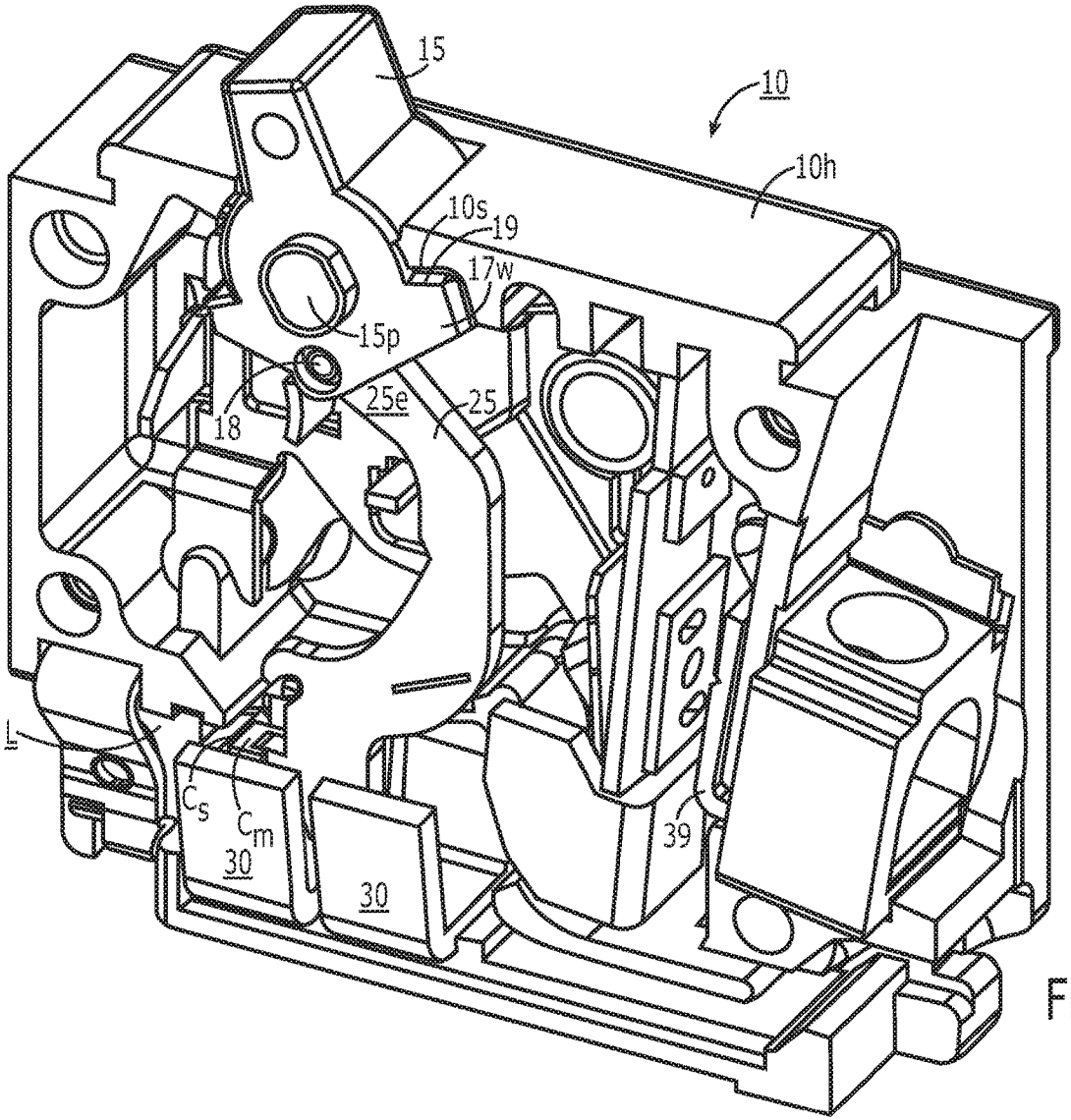
FIG. 3B is a front perspective view of the circuit breaker shown in FIG. 3A illustrating the handle in an "ON" position according to embodiments of the present invention.
Figure 3C:
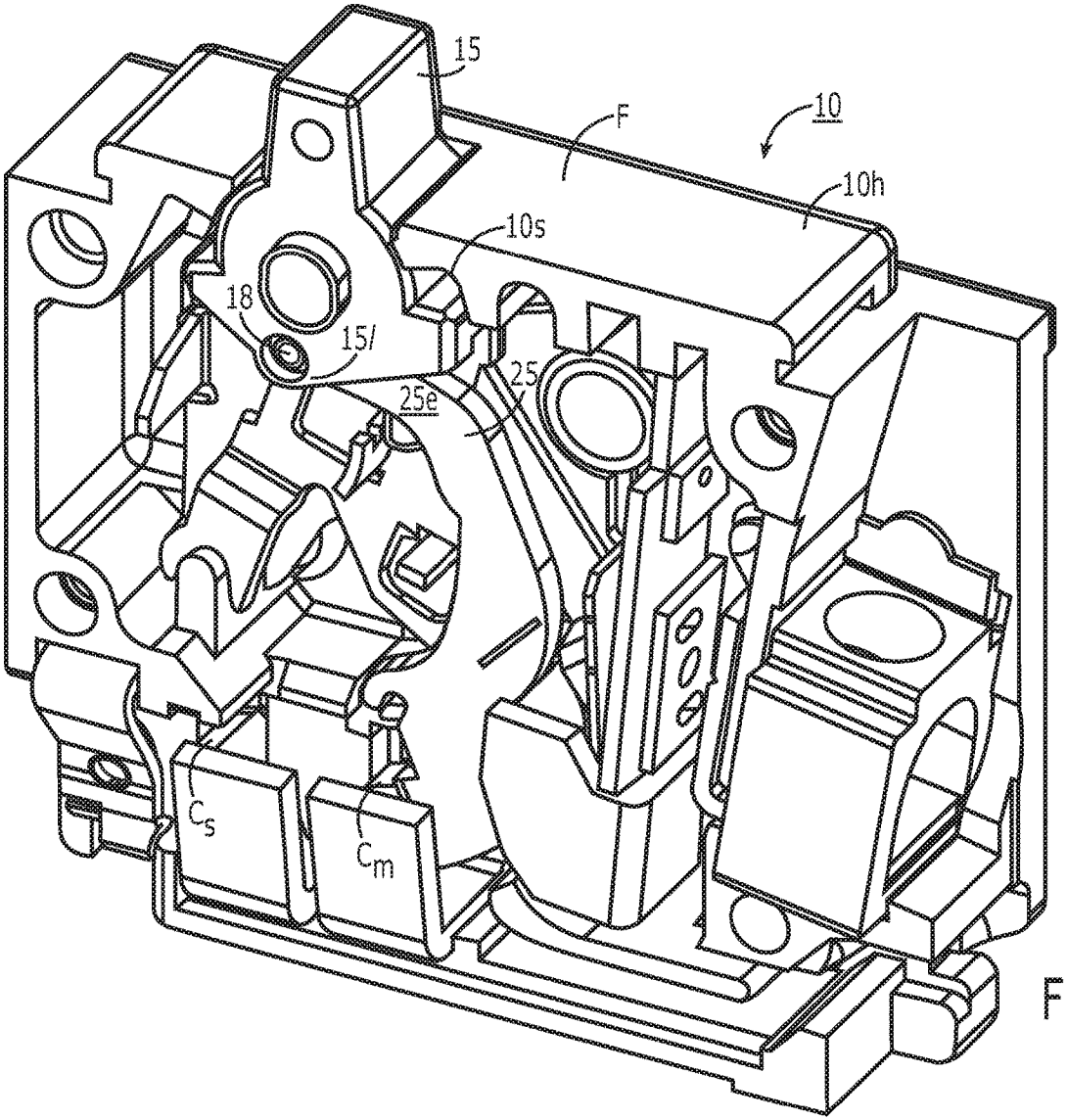
FIG. 3C is a front perspective view of the circuit breaker shown in FIG. 3A illustrating the handle in a "TRIP" position according to embodiments of the present invention.

Turning now to the figures, FIGS. 2A-2C and 3A-3C illustrate an exemplary circuit breaker 10 with a housing 10*h* and handle bearing pin 18 that cooperates with an end portion of an arm 25. FIGS. 2A and 3A illustrate an exemplary handle 15 and arm 25 orientation in an OFF position. FIGS. 2B, 3B illustrate an exemplary orientation in an ON position. FIGS. 2C, 3C illustrate an exemplary orientation in a TRIP position. Typically the circuit breaker 10 is oriented so that the face F of the housing 10*h* is vertical and facing outward so that a user can access the handle 15.

The pin 18 can be held by and/or in the handle 15 so that a longitudinal axis of the pin 18 is parallel to and offset from a pivot axis of the pivotable handle 15, which can provide a suitable torque lever arm.

It is noted that not all circuit breakers 10 require a TRIP position (e.g., fused switches), so in some embodiments, the arm 25 and handle 15 can include only two operative positions, ON, OFF, rather than the noted ON, OFF and TRIP positions.

As is well known, in the housing 10*h*, the circuit breaker 10 includes at least one arc chamber 20 having at least one arc chute 30 with arc plates 31 (FIG. 3A), a mechanism assembly 10*m* with the rotating arm 25 with a contact Cm (e.g., a moving contact attached to the "contact arm") and a stationary contact Cs proximate a line terminal L. The arm 25 is conductive. The arm 25 arm is conductive, typically non-ferromagnetic metal such as, but not limited to, copper. The arc plates 31 can be stacked and are typically configured as closely spaced plates 31 as shown.

Figure 4A:
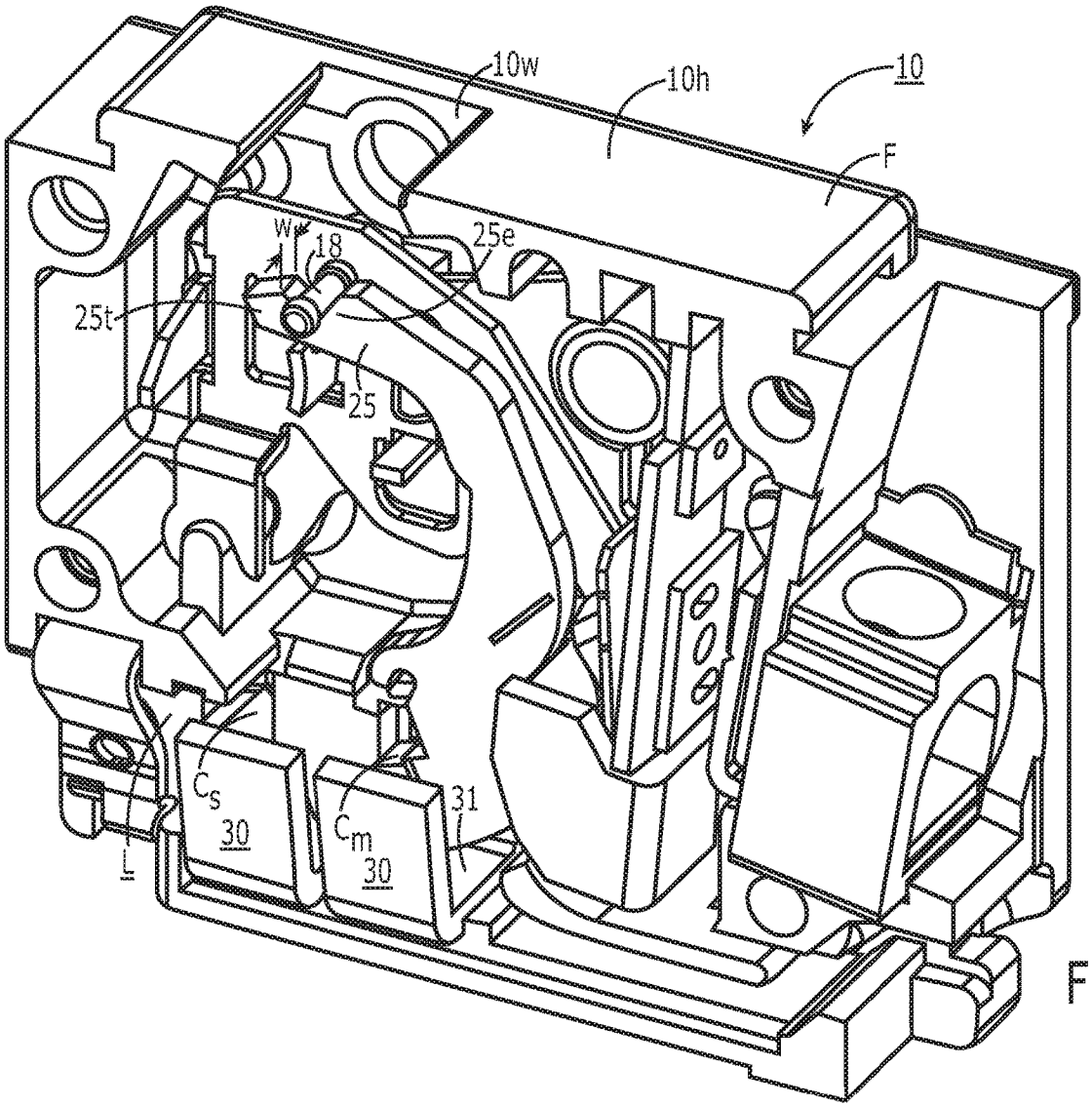
FIGS. 4A and 4B are front perspective views of the circuit breaker shown in FIG. 3A illustrated without the handle according to embodiments of the present invention.

As shown in FIG. 4A, the at least one pin 18 faces an end portion of the arm 25*e* (shown as the upper end in this orientation). The handle 15 can be pivotably attached 15*p* to the circuit breaker housing (directly or indirectly) 10*h* at a location above the pin 18 so as to be able to pivot/rotate between the operative positions. The handle 15 can include an external portion 15*e* which can comprise a user actuator or input such as a lever, thumb or finger wheel or other suitable configuration. The handle pivot 15*p* is typically attached directly or indirectly to the housing 10*h*. While shown as a single pin 18, more than one pin may be used. If so, the pins 18 may be placed side-by-side or one above another (not shown).

The handle 15 can have an internal portion 15*i* with an arm receiving channel 17 that remains inside the housing 10*h* (FIG. 3A). The pin 18 can be held by the internal portion of the handle 15*i* so as to extend across the arm receiving channel 17. The arm receiving channel 17 has a width direction W (FIG. 5A) that corresponds to a width direction of the arm 25 (FIG. 4A) to receive the first (shown as the upper) end portion of the arm 25*e*. Where used, the handle arm-receiving channel 17 extends in a primary lengthwise direction that is orthogonal to the pin 18.

The pin 18 can provide the only direct moving contact between the handle 15 and arm 25.

Figure 4B:
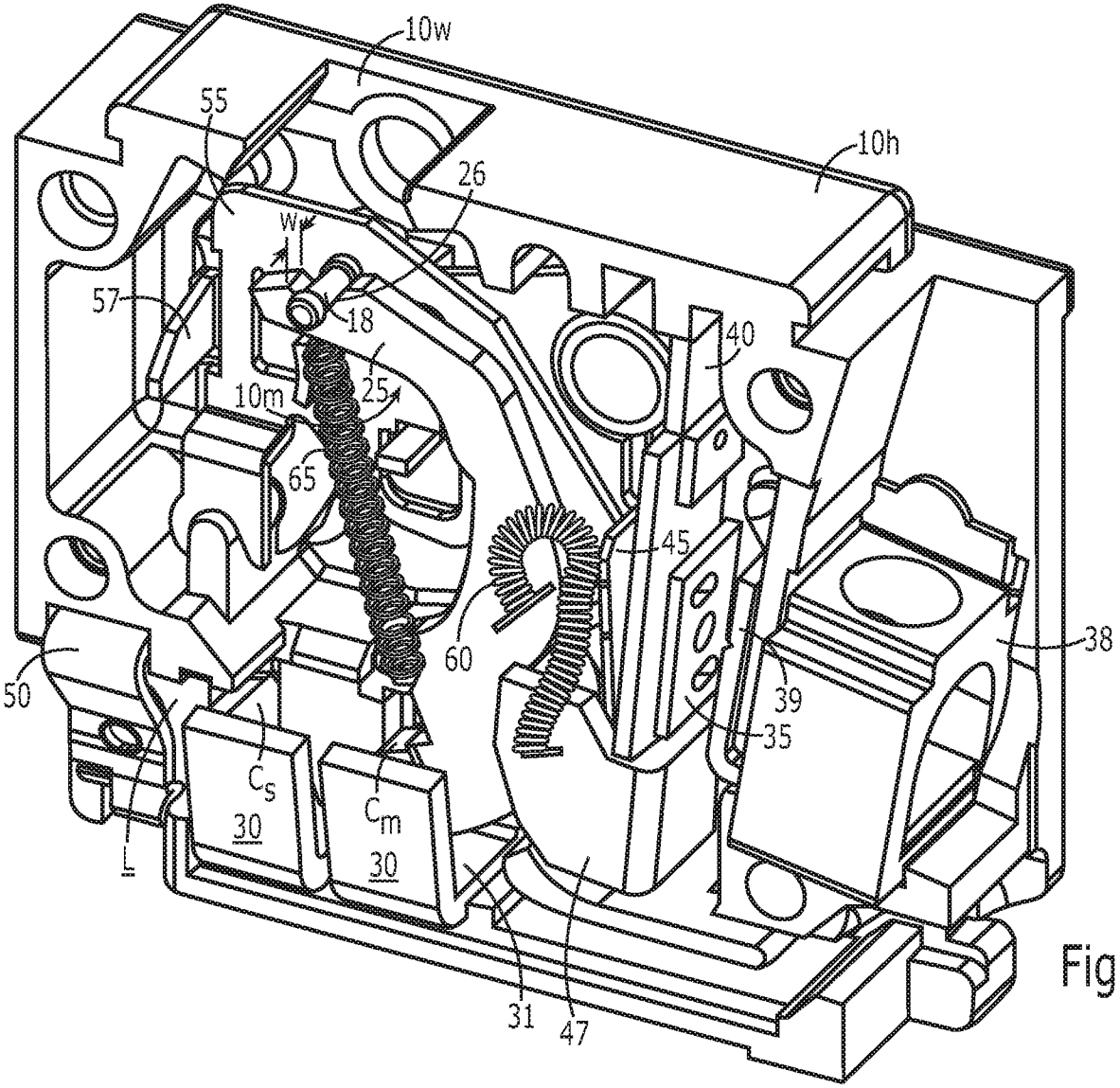

FIGS. 4A and 4B show the circuit breaker 10 with the handle 15 removed to illustrate a handle window 10*w* in the housing 10*h* and an exemplary configuration of the pin 18. In the orientation of the circuit breaker shown, the pin 18 is proximate to, but above the arm 25. The pin 18 typically contacts the end portion 25*e* of the arm that is opposite the movable contact Cm and provides a bearing surface for the handle/arm interface. The pin 18 can reside in the arm channel 26 so as to extend laterally across the end portion of the arm 25*e* in the arm thickness or width W direction. The arm channel 26 can be configured as a depression, well, groove or other channel configuration. The arm channel 26 can be curvilinear. The pin 18 can be configured to directly contact the arm channel 26 and remain in contact with the arm channel through the movement of the arm 25 as it pivots or travels between the operative positions.

Still referring to FIGS. 4A and 4B, the channel 26 can be arcuate or have an arcuate segment. The channel 26 can have a radius of curvature that corresponds to a radius of the outer wall of the pin 18. The arm channel 26 can have a center that is positioned and configured to be concentric with an axially extending centerline of the pin 18. In some particular embodiments, the radius of curvature and/or outer pin radius can be between about 0.034 to about 0.045 inches. In some particular embodiments, the arm channel 26 can have a lateral width W that is typically between about 0.95 inches to about 0.165 inches. The arm channel 26 can be open in a direction facing the pin 18 (shown facing upward) to be able to slidably receive the pin 18.

Referring again to FIGS. 2A-2C, 3A-3C and FIG. 4A, the circuit breaker 10 can also include one or more of a magnet 35, a load collar 38, a load terminal 39, a bimetal member 40, an armature 45, a shunt bracket 47, a spring clip 50, a cradle 55 and frame 57. The circuit breaker 10 can have alternate configurations and components.

FIG. 4B also schematically illustrates a shunt 60 attached to the arm 25 and shunt bracket 47. The shunt 60 can be resilient and/or flexible. FIG. 4B also schematically illustrates a mechanism spring 65 which is part of the operator mechanism 10*m*, as is well known to those of skill in the art.

A respective circuit breaker 10 can have a plurality of respective pairs of handles 15 and arms 25 as is also well known in the art.

FIGS. 3A-3B illustrate that the handle 15 can have a laterally extending aperture 16 that holds the pin 18 and a channel 17 between sidewalls 17*w* of a lower portion of the handle 15 that receive the upper end portion of the arm 25.

As discussed above, the handle 15 can have an internal portion 15*i* with channel 17 (FIG. 3A) to slidably receive the end portion of the arm 25*e*. The pin 18 can extend across the channel 17 at an inner end portion of the channel 17 proximate thereby allowing the pin 18 to form the handle bearing contact surface for the arm 25.

FIGS. 3A-3C also illustrate exemplary handle and arm positions for different operative positions, OFF, ON and TRIP. The movements can be over a desired angulation, typically between about 45 degrees to about 90 degrees, more typically about 90 degrees between the OFF and ON positions with the TRIP position between the OFF and ON. In the ON position, the arm 25 places the moveable contact Cm in abutting contact with the stationary contact Cs (FIG. 3B). In the OFF position, the arm 25 rotates to move the moveable contact Cm away from the stationary contact Cs (FIG. 3A). In the TRIP position, the arm 25 also positions the moveable contact Cm away from the stationary contact Cs (FIG. 3C), typically a distance greater than the spaced apart distance of the two contacts Cs, Cm in the "OFF" position. The upper end of the arm 25*e* is able to move relative to the handle 15 in the arm receiving channel 17 of the handle while the pin 18 remains in the arm channel 26 (FIG. 4A). Stated differently, the arm channel 26 cooperates with the pin 18 so that the end portion of the arm 25*e* rocks back and forth across the pin 18 as the handle 15 moves through different operative positions. Compare the position of the upper end of the arm 25*e* with the handle channel 17 in FIGS. 3A-3C.

The handle 15 with the pin 18 can be provided as a handle bearing assembly/subassembly.

With the circuit breaker oriented with the handle 15 extending upward as shown, the arm 25 can be configured to have an elongate concave shape with the upper end portion 25*e* having a tip end 25*t*. The arm receiving channel 17 can extend across an entire bottom portion of the handle 15*l* and can have an open tip end 17*t* (FIG. 5B, 6A) that allows the tip end of the arm 25*t* to move relative thereto so as to retract (FIG. 2B) and extend (FIG. 2A) therefrom. The pin 18 can be held closer to the tip end of the arm receiving channel 17*t* (FIG. 5B, 6A) relative to the other end of the channel.

The circuit breaker 10 can be configured to provide a stop 10*s* proximate the window 10*w* and extending inwardly to contact a handle ledge 19 that extends above the arm channel 17 when the handle 15 is in the ON position (FIG. 3B).

Figure 5A:
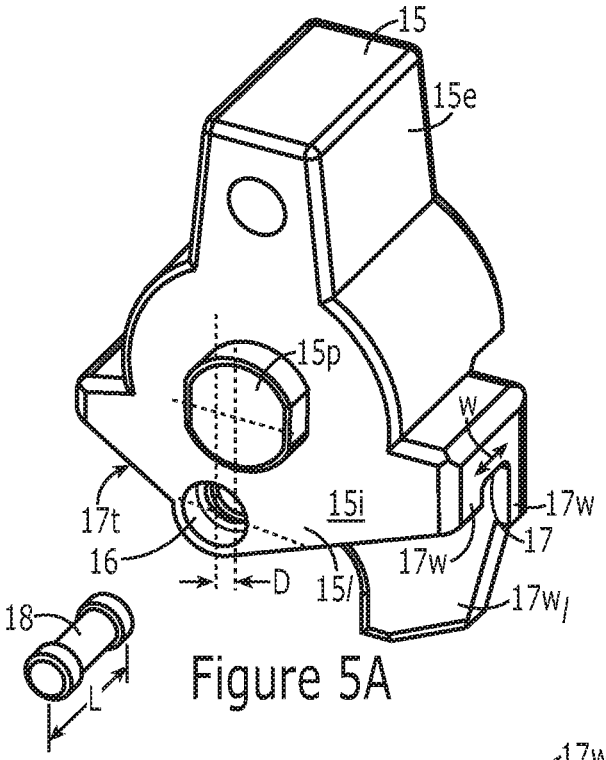
FIG. 5A is an enlarged exploded top perspective view of a handle and pin assembly for a circuit breaker according to embodiments of the present invention.
Figure 5B:
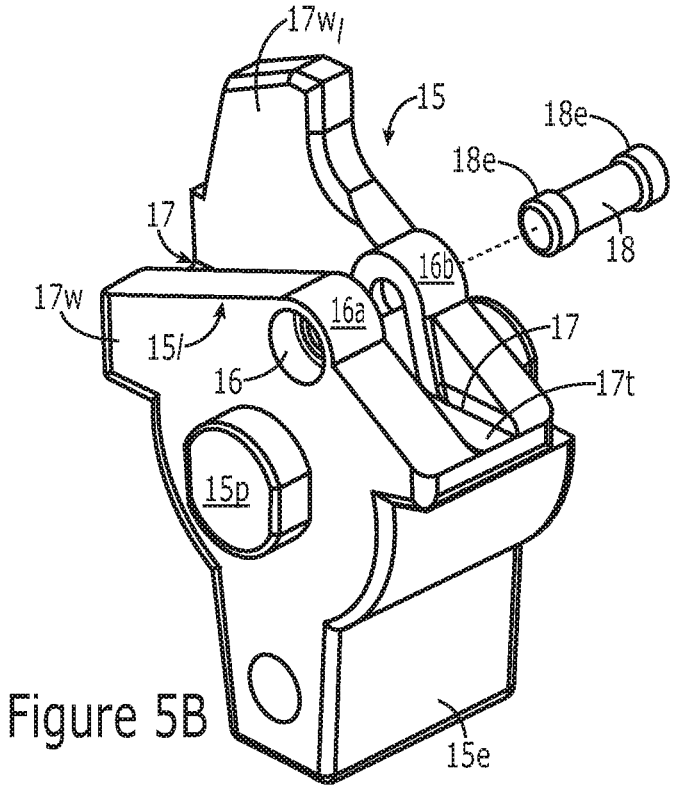
FIG. 5B is an enlarged exploded bottom perspective view (with the handle orientation shown upside down from the view of FIG. 5A) according to embodiments of the present invention.

FIGS. 5A and 5B illustrate a greatly enlarged view of an exemplary handle 15 and exemplary pin 18. The pin 18 is sized and configured to be received in the pin aperture 16. The pin aperture 16 can have an axially extending centerline that is offset a distance D from the axially extending centerline of the pivot attachment 15*p* of the handle 15. In some particular embodiments, the distance D can be between about 0.09 inches to about 0.200 inches. In some particular embodiments, the distance D can be between about 0.091 inches to about 0.097 inches, such as about 0.094 inches. The pin 18 is typically not centered, residing closer to the left side of the handle than the right side of the handle in the orientation shown in FIGS. 2A and 5A, for example.

The handle arm channel 17 can have sidewalls 17*w* on both sides, one of which can be longer than the other, 17*wl*. The longer channel 17*wl* can extend down a distance that is between about 1.5× to about 10 times the length of the shorter sidewall, typically between about 2× to about 5×, such as about 3×.

The arm receiving channel 17 can extend across an entire diameter of a bottom portion of the handle as shown in FIG. 5B. The pin 18 can be configured to reside closer one side of the handle 15 under and offset from the handle pivot 15*p*. The handle 15 can include attachment segments (e.g., bosses or shoulders) 16*a*, 16*b* that provide the pin aperture 16 and reside on opposing sides of the channel 17 to allow the pin 18 to extend therethrough and across the channel 17, when attached to the handle 15. The pin 18 may include end portions 18*e* that have a larger size so as to hold the pin in position. Of course, other lock and/or securing configurations may be used including frictional engagement, cotter pins, nuts, clamps, or adhesives.

Figure 6A:
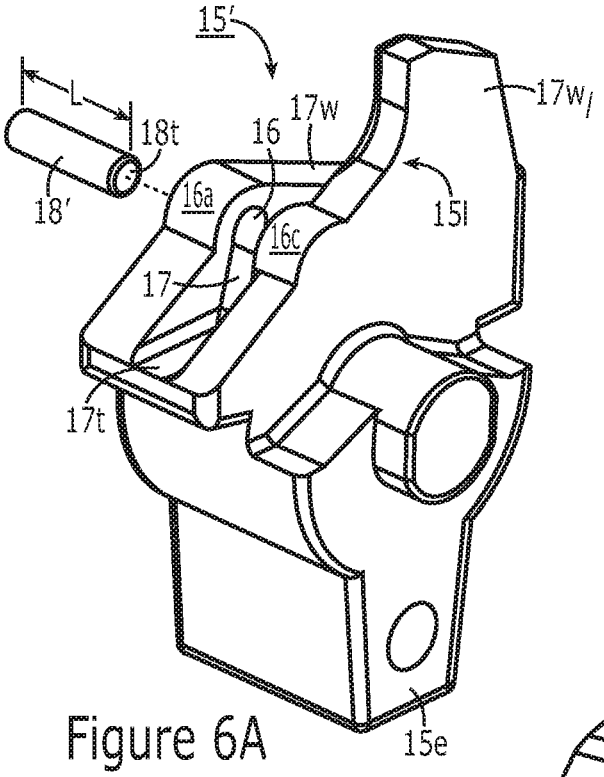
FIG. 6A is an enlarged exploded top perspective view of a handle and pin assembly for a circuit breaker according to embodiments of the present invention.
Figure 6B:
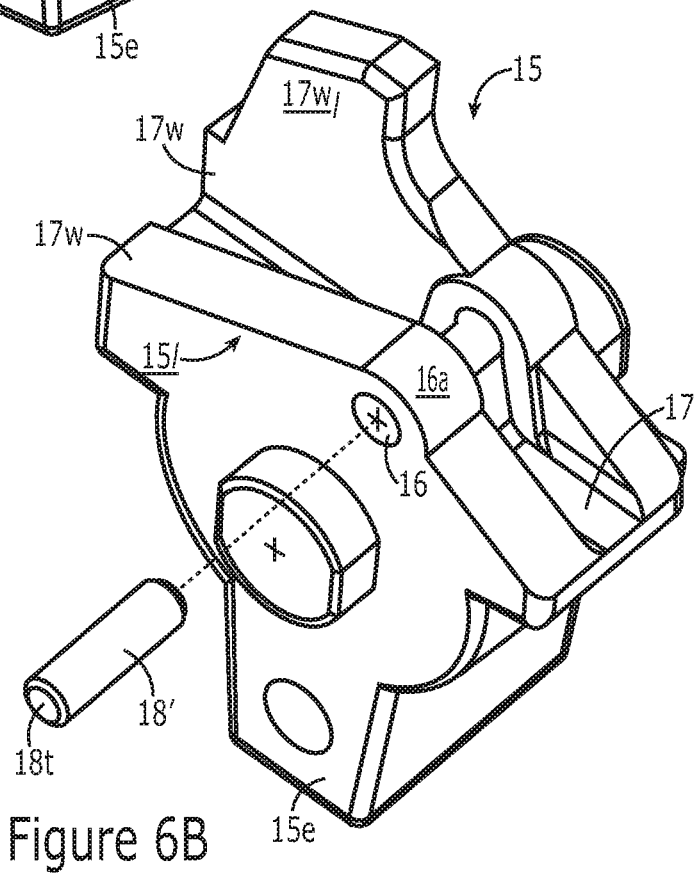
FIG. 6B is an enlarged exploded bottom perspective view (with the handle orientation shown upside down from the view of FIG. 6A) according to embodiments of the present invention.

FIGS. 6A and 6B illustrate another exemplary pin 18' and handle 15' configuration. In this embodiment, the pin 18' can be held by a pin aperture 16 with a blind side 16*c*. Thus, the handle 15 has one shoulder 16*a* on one side of the channel 17 and a blind channel 16*c* on the other side that cooperate to hold the pin 18'. This configuration may be described as a "drop" pin handle. The pin 18' can only be inserted in one direction. The end of the pin may be tapered 18*t*. In position, a shorter portion of the length of the pin 18' may reside in the blind side 16*c* relative to the open pin aperture on the other side 16*a*. Again, the pin aperture 16 may be offset from the pivot 15*p* a distance D and/or angle $\alpha$ as noted above. The pin 18' may be assembled or attached in any suitable manner, such as, but not limited to, those describe above.

Figure 7A:
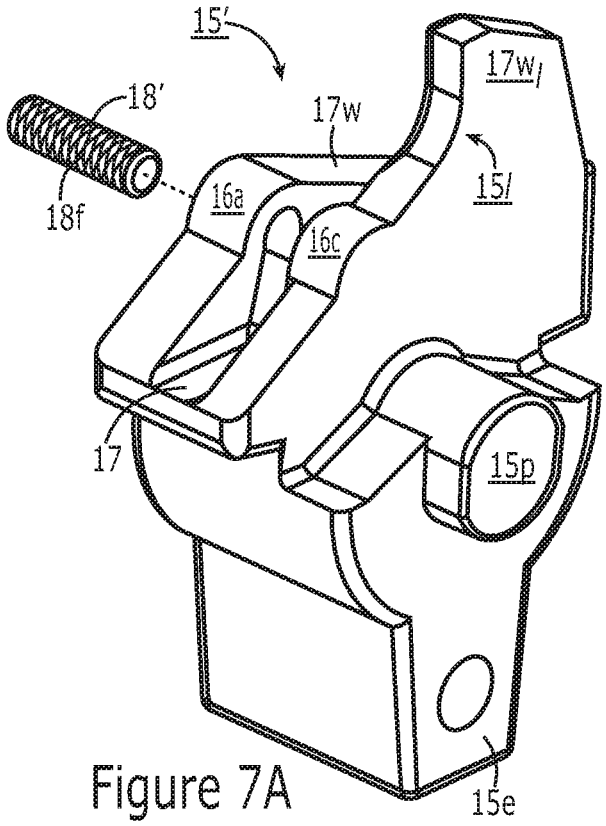
FIGS. 7A and 7B are enlarged exploded bottom perspective views illustrating alternate pin and/or pin channel configurations according to embodiments of the present invention.
Figure 7B:
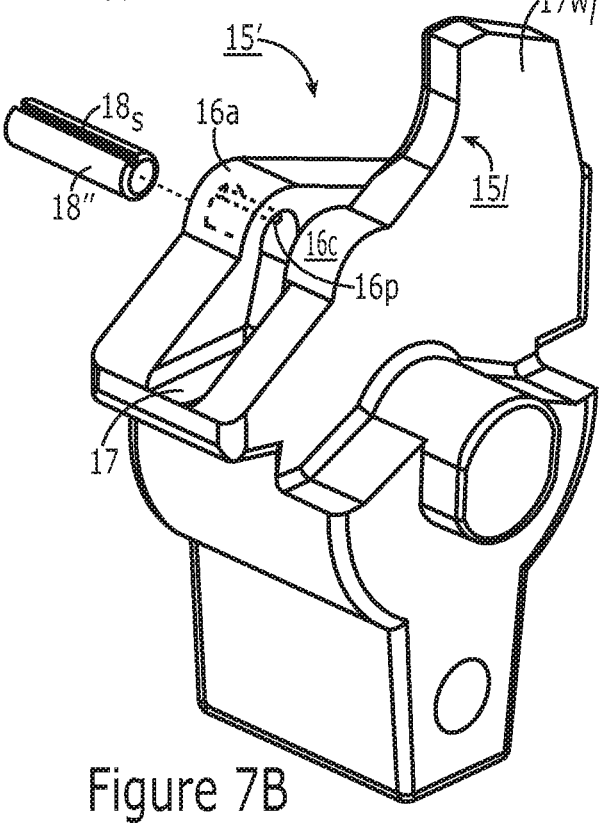

FIGS. 7A and 7B illustrate exemplary outer surface features 18*s* that the pin 18" can include to facilitate secure, preferably non-rotatable, attachment to the handle 15. Non-rotatable attachments, e.g., allowing the arm 25 to rock over the pin 18, 18', 18" while preventing or inhibiting the pin 18 from rotating in the handle 15, can inhibit undue wear. These or other features can be used for the pin 18' as shown in FIGS. 5A/5B. FIG. 7A illustrates an outer surface with increased friction 18*f* relative to a smooth outer surface, such as a knurled or embossed surface. FIG. 7B illustrates the pin 18" can include at least one shaped segment 18*s* such as a key, channel or flat surface that can matably attach to a protrusion or key 16*p* in the wall of the pin aperture 16. Although shown as a single channel and corresponding protrusion, a plurality of circumferentially spaced apart features may be used.

Figure 8A:
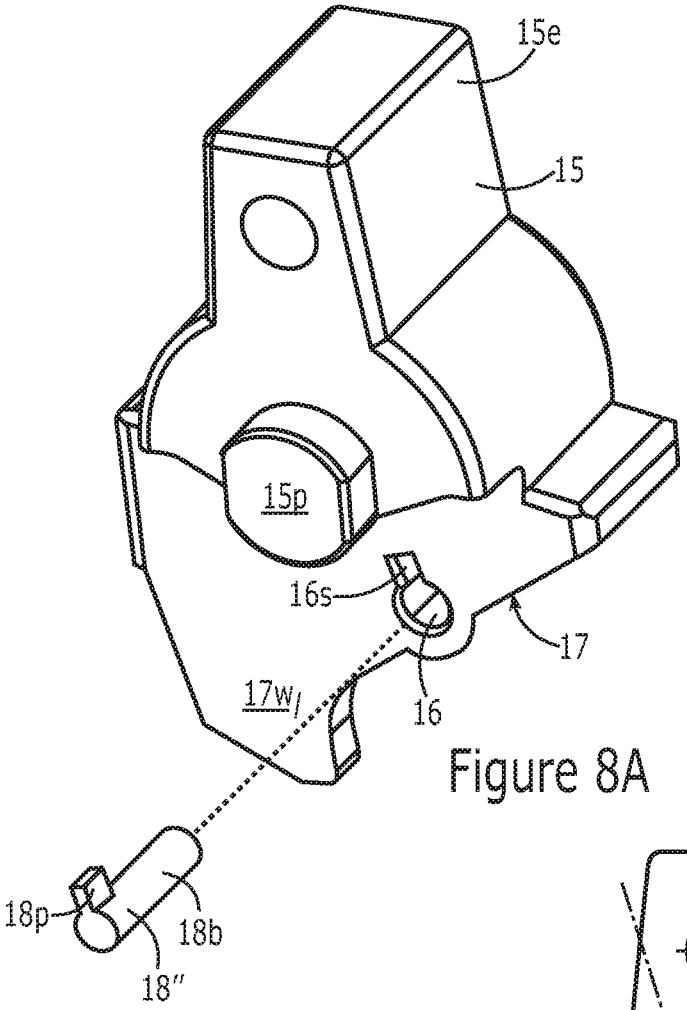
FIG. 8A is an exploded side perspective view of another handle and pin configuration according to embodiments of the present invention.
Figure 8B:
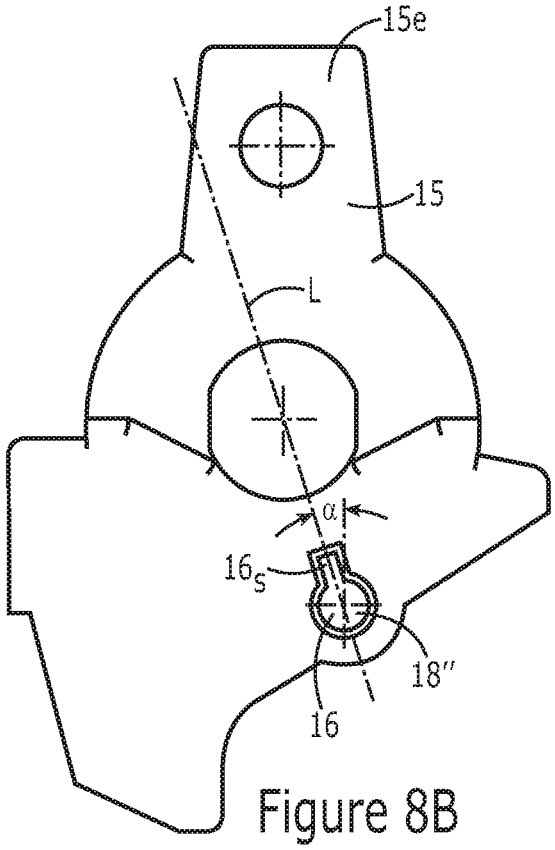
FIG. 8B is a front view of the handle and pin (assembled) shown in FIG. 8A.

As shown in FIGS. 8A and 8B, the reverse can also be used, e.g., the pin 18" can have the projection 18*p* and the handle pin aperture 16 can have a wall with the shaped receiving slot 16*s*. In the embodiment shown, the protrusion 18*p* extends less than a major length of the overall length of the pin 18" and, when inserted in the handle 15, typically faces the outer end of the pin receiving channel 16 in the handle 15. The pin projection 18*p* can radially extend a distance of between about 0.02 inches to about 0.05 inches from the primary pin body 18*b*. The pin body 18*b* can have a diameter of between about 0.06 inches and about 0.075 inches, in some embodiments. The pin slot 16*s* can be oriented to along a line L that intersects the centerline of the pin 18 and the centerline of the pivot of the handle 15*p*. The line L can be offset from vertical by an angle α that is typically between about 10-60 degrees, more typically between about 10-30 degrees, such as about 10 degrees, about 11 degrees, about 12 degrees, about 13 degrees, about 14 degrees, about 15 degrees, about 16 degrees, about 17 degrees, about 17.5 degrees, about 18 degrees, about 19 degrees, about 20 degrees, about 21 degrees, about 22 degrees, about 23 degrees, about 24 degrees, about 25 degrees and about 30 degrees. The pin slot 16*s* can be formed in the shoulder 16*a* (FIG. 6A) to hold the projection 18*p*, with the opposing circular end of the pin 18" held in the blind channel 16*c* (FIG. 6A) across the open space for the arm channel 17. Of course, an open pin channel such as that provided by shoulder 16*b* in FIG. 5B may be used.

In some embodiments, the line L can be drawn through the axially extending centerline of the pin 18, 18', 18" and the center of the pivot axis 15*p* with the angles of the line L being α as described above for the pin slot 16*s* in FIGS. 8A/8B, whether the pin slot configuration is used or not. Thus, in some embodiments, the line L can be offset from vertical by the angle α that is typically between about 10-60 degrees, more typically between about 10-30 degrees, such as about 10 degrees, about 11 degrees, about 12 degrees, about 13 degrees, about 14 degrees, about 15 degrees, about 16 degrees, about 17 degrees, about 17.5 degrees, about 18 degrees, about 19 degrees, about 20 degrees, about 21 degrees, about 22 degrees, about 23 degrees, about 24 degrees, about 25 degrees and about 30 degrees.

The pin 18, 18', 18" can be configured as a free floating or loose pin and is not required to be non-rotatable, in some embodiments.

Combinations of the pin configurations or other surface features may also be used, alone or with adhesives or other securing or locking configurations.

The at least one pin 18, 18', 18" may be electrically conductive or electrically non-conductive. The at least one pin 18, 18', 18" may comprise a metallic material or other suitable wear-resistant, sufficiently durable material. The at least one pin 18, 18', 18" may comprise a ceramic or fiber and/or glass reinforced resin. The at least one pin 18, 18', 18" may comprise a sufficiently rigid polymeric material. The at least one pin 18, 18', 18" may be a monolithic unitary member or comprise matable members or more than one material or a primary substrate with a coating, for example. The at least one pin 18, 18', 18" can be non-ferromagnetic.

The pin 18, 18', 18" can have a length L that is between about 0.115 inches and about 0.328 inches, in some embodiments. The channel 17 can have a width W that is greater than the length of the pin 18, 18', 18", typically between about 1.1× to about 1.25×, a width W that is about the same length of the pin 18, 18', 18" or a width W that is less than a length of the pin 18, 18', 18". If the pin 18, 18', 18" has a length that is less than a width of the channel 17, the length L is sufficient to extend across the channel 17 to engage a sidewall 17*w* on each side.

The pin 18, 18' may be held by the handle 15 in other configurations, e.g., without requiring or outside of a channel 17.

The handle 15 can be a monolithic molded polymeric member. The at least one pin 18, 18', 18", typically a single pin, can be any suitable material and can be selected to provide the durability and performance criteria associated with UL 489 endurance testing. The pin 18, 18', 18" can be attached to the handle 15 in any suitable manner. The pin 18, 18', 18" can be inserted into a pre-formed pin aperture 16. The pin 18, 18', 18" may be overmolded into the handle 15 without requiring a pre-formed pin aperture 16. The pin 18, 18', 18" may be ultrasonically welded and/or inserted into the handle 15. The pin 18, 18', 18" may be punched, pressed or otherwise physically inserted into the aperture 16.

In some embodiments, the circuit breakers 10 can be DC circuit breakers, AC circuit breakers, or both AC and DC circuit breakers.

The circuit breakers 10 can be rated for voltages between about 1 V to about 5000 volts (V) DC and/or may have current ratings from about 15 to about 2,500 Amperes (A). The circuit breakers 10 may be high-rated miniature circuit breakers, e.g., above about 70 A in a compact package. However, it is contemplated that the circuit breakers 10 and components thereof can be used for any voltage, current ranges and are not limited to any particular application as the circuit breakers can be used for a broad range of different uses.

The circuit breakers 10 can be a bi-directional direct current (DC) molded case circuit breaker (MCCB). See, e.g., U.S. Pat. Nos. 5,131,504 and 8,222,983, the contents of which are hereby incorporated by reference as if recited in full herein. The DC MCCBs can be suitable for many uses such as data center, photovoltaic, and electric vehicles applications.

As is known to those of skill in the art, Eaton Corporation has introduced a line of molded case circuit breakers (MCCBs) designed for commercial and utility scale photovoltaic (PV) systems. Used in solar combiner and inverter applications, Eaton PVGard™ circuit breakers are rated up to 600 amp at 1000 Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating. In some particular embodiments, the circuit breaker 10 can be a high-rating miniature circuit breaker.

The circuit breaker 10 may be particularly suitable for the BR circuit breakers with a thermal-magnetic trip curve that avoids nuisance tripping on mild overloads while reacting almost instantaneously to severe short-circuit conditions, such as the BRX circuit breaker from Eaton Corporation, Cleveland, Ohio.

The handle bearing configuration provided by the pin 18, 18', 18" can remove a plastic wear point of the prior art configuration and reduce wear, eliminate or reduce wear and heat (friction induced) relative to the design shown in FIG. 1. The pin 18, 18', 18" may have detectable wear of only about 0.001 inches after endurance testing carried out under UL 489 (BR2125) for at least 3000 repetitions, typically after about 10,000 repetitions/operations.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A circuit breaker comprising:

a housing;

a pivotable handle held by the housing, wherein the handle comprises first and second laterally spaced apart pin channels facing each other across a contact arm receiving channel, the first pin channel extending on one side of the contact arm receiving channel and the second pin channel extending on an opposing side of the contact arm receiving channel;

a pin held by the handle such that a longitudinal axis of the pin is parallel to and offset from a pivot axis of the pivotable handle, wherein the pin has a length with longitudinally opposing first and second end portions, wherein the first and second end portions are enlarged relative to a medial segment of the pin, and wherein, in position, the pin extends from the first pin channel, across the contact arm receiving channel, into the second pin channel; and a moveable contact arm comprising a first end portion in the contact arm receiving channel of the handle that directly contacts the medial segment of the pin across a width of the first end portion of the moveable contact arm, wherein the medial segment of the pin is exposed across the contact arm receiving channel and directly contacts and cooperates with the first end portion of the moveable contact arm to define a bearing surface interface between the handle and the contact arm, wherein the pin is metallic, wherein the medial segment of the pin has a length that is greater than either of the first and second end portions, and wherein the length corresponds to the width of the first end portion of the contact arm.

2. The circuit breaker of claim 1, wherein the pin is statically attached to the handle, and wherein the pin moves with the handle but does not rotate relative to the handle.

3. The circuit breaker of claim 1, wherein the first and second laterally spaced apart pin channels each comprise an outer facing end segment that is enlarged relative to an internal segment thereof.

4. The circuit breaker of claim 1, wherein outer facing end surfaces of the first and second end portions of the pin are recessed in the first and second pin channels, wherein at least one outer surface of the handle comprises an aperture with a diameter greater than a diameter of one or both of the first and second end portions of the pin, and wherein the aperture is aligned with the first and second pin channels.

5. A circuit breaker comprising:

a housing;

a pivotable handle held by the housing, wherein the handle comprises first and second laterally spaced apart pin channels facing each other across a contact arm receiving channel, the first pin channel extending on one side of the contact arm receiving channel and the second pin channel extending on an opposing side of the contact arm receiving channel;

a pin held by the handle such that a longitudinal axis of the pin is parallel to and offset from a pivot axis of the pivotable handle, wherein the pin has a length with longitudinally opposing first and second end portions, wherein the first and second end portions are enlarged relative to a medial segment of the pin, and wherein, in position, the pin extends from the first pin channel, across the contact arm receiving channel, into the second pin channel; and a moveable contact arm comprising a first end portion in the contact arm receiving channel of the handle that contacts the medial segment of the pin across a width of the first end portion of the moveable contact arm, wherein the medial segment of the pin defines a handle/contact arm bearing interface, wherein the handle comprises first and second laterally spaced apart shoulders that reside on opposing sides of the contact arm receiving channel and contain or are adjacent the first and second pin channels, and wherein the first shoulder has a greater inwardly extending length than the second shoulder.

6. The circuit breaker of claim 1, wherein the moveable contact arm has a second end portion opposing the first end portion, wherein the contact arm receiving channel in the handle is orthogonal to the pin, wherein the second end portion of the moveable contact arm comprises an electrical contact, wherein the circuit breaker further comprises a stationary electrical contact held in the housing so as to selectively electrically engage the contact of the moveable arm, and wherein the first end portion of the moveable contact arm moves in the contact arm receiving channel while contacting the pin as the handle moves between ON and OFF positions.

7. The circuit breaker of claim 6, wherein the circuit breaker has a TRIP position, wherein the first end portion of the moveable contact arm contacts the pin as the moveable contact arm and handle move between the ON and OFF positions and the TRIP position.

8. The circuit breaker of claim 1, wherein the first end portion of the moveable contact arm has a laterally extending channel that spans across an entire width of the width of the first end portion of the contact arm and is arcuate and open in a direction facing the handle and that abuts and holds the medial segment of the pin providing the direct contact of the first end portion of the moveable contact arm.

9. The circuit breaker of claim 8, wherein the laterally extending channel of the moveable contact arm has a radius of curvature that corresponds to a radius of the medial segment of the pin.

10. A circuit breaker comprising:

a housing;

a pivotable handle held by the housing, wherein the handle comprises first and second laterally spaced apart pin channels facing each other across a contact arm receiving channel, the first pin channel extending on one side of the contact arm receiving channel and the second pin channel extending on an opposing side of the contact arm receiving channel;

a pin held by the handle such that a longitudinal axis of the pin is parallel to and offset from a pivot axis of the pivotable handle, wherein the pin has a length with longitudinally opposing first and second end portions, wherein the first and second end portions are enlarged relative to a medial segment of the pin, and wherein, in position, the pin extends from the first pin channel, across the contact arm receiving channel, into the second pin channel; and a moveable contact arm comprising a first end portion in the contact arm receiving channel of the handle that directly contacts the medial segment of the pin across a width of the first end portion of the moveable contact arm, wherein the medial segment of the pin is exposed across the contact arm receiving channel and directly contacts and cooperates with the first end portion of the moveable contact arm to define a bearing surface interface between the handle and the contact arm, wherein the length of the pin is greater than the width of the first portion of the moveable contact arm, wherein the medial segment of the pin has a length that is greater than either of the first and second end portions, and wherein, with the circuit breaker oriented with the handle extending upward, the first end portion of the moveable contact arm can move back and forth under the pin while in continuous abutting contact with the pin.

11. The circuit breaker of claim 1, wherein the pin has an axially extending centerline that is longitudinally and laterally offset from the pivot axis of the handle and abuts an arcuate surface in a substrate of the first end portion of the moveable contact arm defining a laterally extending open channel in the first end portion of the moveable contact arm to hold and provide the direct contact of the medial segment of the pin with the first end portion of the moveable contact arm, and wherein the pin has a radius that is between about 0.034 inches and about 0.045 inches.

12. The circuit breaker of claim 1, wherein the first end portion of the moveable contact arm has a curvilinear pin channel that is open in a direction facing the handle and that directly contacts the medial segment of the pin.

13. The circuit breaker of claim 1, wherein the first end portion of the moveable contact arm has an arcuate pin channel with an open laterally extending surface facing the pin that holds the pin, and wherein the pin is non-rotatably mounted to the handle.

14. A circuit breaker comprising:

a housing;

a pivotable handle held by the housing, wherein the handle comprises first and second laterally spaced apart pin channels facing each other across a contact arm receiving channel, the first pin channel extending on one side of the contact arm receiving channel and the second pin channel extending on an opposing side of the contact arm receiving channel;

a pin held by the handle such that a longitudinal axis of the pin is parallel to and offset from a pivot axis of the pivotable handle, wherein the pin has a length with longitudinally opposing first and second end portions, wherein the first and second end portions are enlarged relative to a medial segment of the pin, and wherein, in position, the pin extends from the first pin channel, across the contact arm receiving channel, into the second pin channel; and a moveable contact arm comprising a first end portion in the contact arm receiving channel of the handle that directly contacts the medial segment of the pin across a width of the first end portion of the moveable contact arm, wherein the medial segment of the pin is exposed across the contact arm receiving channel and directly contacts and cooperates with the first end portion of the moveable contact arm to define a bearing surface interface between the handle and the contact arm, wherein the medial segment has a length that is greater than either of the first and second end portions, wherein the pin is metallic, wherein the handle is polymeric, wherein the longitudinal axis of the pin is perpendicular to a long side of the housing and resides longitudinally and laterally offset from the pivot axis of the handle, wherein the length of the pin is between about 0.115 inches and about 0.328 inches, and wherein the medial segment of the pin has a radius that is between about 0.034 inches and about 0.045 inches.

15. The circuit breaker of claim 1, wherein either the pin has an outer surface with a longitudinally extending slot that engages a key feature in the handle or the handle has a slot that engages a key feature of the pin.

16. The circuit breaker of claim 1, wherein the pin has an embossed or knurled outer surface.

17. The circuit breaker of claim 1, wherein the first end portion of the movable contact arm comprises a tip end, wherein the contact arm receiving channel extends across an entire bottom portion of the handle in a direction orthogonal to the first and second pin channels and has a tip end that allows the tip end of the moveable contact arm to retract and extend therefrom.

18. A circuit breaker comprising:

a housing;

a pivotable handle held by the housing, wherein the handle comprises first and second laterally spaced apart pin channels facing each other across a contact arm receiving channel, the first pin channel extending on one side of the contact arm receiving channel and the second pin channel extending on an opposing side of the contact arm receiving channel;

a pin held by the handle such that a longitudinal axis of the pin is parallel to and offset from a pivot axis of the pivotable handle, wherein the pin has a length with longitudinally opposing first and second end portions, wherein the first and second end portions are enlarged relative to a medial segment of the pin, and wherein, in position, the pin extends from the first pin channel, across the contact arm receiving channel, into the second pin channel; and a moveable contact arm comprising a first end portion in the contact arm receiving channel of the handle that contacts the medial segment of the pin across a width of the first end portion of the moveable contact arm, wherein the medial segment of the pin defines a handle/contact arm bearing interface, wherein the handle has laterally spaced apart inwardly extending sidewalls, one on each side of the contact arm receiving channel, and wherein one of the sidewalls has a segment with a length that is 1.5 to 5 times longer than the other of the sidewalls.

* * * * *